US006217675B1

(12) United States Patent
Taniguchi et al.

(10) Patent No.: US 6,217,675 B1
(45) Date of Patent: Apr. 17, 2001

(54) COLD ROLLED STEEL SHEET HAVING IMPROVED BAKE HARDENABILITY

(75) Inventors: Hirokazu Taniguchi; Kazumasa Yamazaki; Koichi Goto, all of Tokai (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/486,515

(22) PCT Filed: Apr. 5, 1999

(86) PCT No.: PCT/JP99/01793

§ 371 Date: Feb. 28, 2000

§ 102(e) Date: Feb. 28, 2000

(87) PCT Pub. No.: WO00/00657

PCT Pub. Date: Jan. 6, 2000

(30) Foreign Application Priority Data

Jun. 30, 1998 (JP) ..... 10-184346

(51) Int. Cl.[7] ..... C22C 38/12; C22C 38/14

(52) U.S. Cl. ..... 148/328; 148/330; 420/121; 420/124; 420/126; 420/127

(58) Field of Search ..... 148/328, 330; 420/121, 124, 126, 127, 128, 8

(56) References Cited

U.S. PATENT DOCUMENTS

| | | | | |
|---|---|---|---|---|
| 5,356,494 | * | 10/1994 | Okada et al. | 148/330 |
| 5,558,726 | * | 9/1996 | Yatoh et al. | 148/328 |
| 5,954,896 | * | 9/1999 | Koyama et al. | 148/533 |

FOREIGN PATENT DOCUMENTS

| | | |
|---|---|---|
| 61-250113 | 11/1986 | (JP) . |
| 63-241122 | 10/1988 | (JP) . |
| 1-191739 | 8/1989 | (JP) . |
| 4-323346 | 11/1992 | (JP) . |
| 5-125484 | 5/1993 | (JP) . |
| 5-331553 | 12/1993 | (JP) . |

* cited by examiner

*Primary Examiner*—John P Sheehan
(74) *Attorney, Agent, or Firm*—Kenyon & Kenyon

(57) ABSTRACT

Cold rolled steel sheets having improved bake hardenability is provided. Specifically, the present invention relates to a cold rolled steel sheet, with improved bake hardenability, comprising an ultra low carbon steel containing titanium and/or niobium, wherein the relationship between the contents of carbon and molybdenum in solid solution being regulated in a specified range, and a cold rolled steel sheet, with improved bake hardenability, which further contains a specified amount of boron in addition to the above constituents.

3 Claims, 1 Drawing Sheet

COLD ROLLED STEEL SHEET HAVING IMPROVED BAKE HARDENABILITY

TECHNICAL FIELD

The present invention relates to a steel sheet, more particularly to a cold rolled steel sheet having improved bake hardenability.

BARCKGROUND ART

For example, Japanese Patent Laid-Open Nos. 141526/1980 and 141555/1980 disclose a method for improving the bake hardenability of cold rolled steel sheets. Specifically, regarding niobium-containing steels, a method is known wherein niobium is added in an amount depending upon the contents of carbon, nitrogen, and aluminum in the steel to limit, in terms of at. %, niobium/(carbon in solid solution+nitrogen in solid solution) to a certain range, thereby regulating the content of carbon in solid solution and the content of nitrogen in solid solution in steel sheets and, in addition, regulating the cooling rate after annealing. Another method known in the art is such that titanium and niobium are added in combination to prepare a steel sheet having excellent bake hardenability (Japanese Patent Laid-Open No. 45689/1986). Mere regulation of the content of carbon in solid solution to the certain range, however, leads to only an expectation of an improvement in bake hardenability of about 30 MPa at the highest. Increasing the amount of carbon in solid solution in order to further improve the bake hardenability results in deteriorated age hardenability which poses a problem that pressing after storage for a long period of time causes a stripe pattern called "stretcher strain." For this reason, satisfying both excellent bake hardenability and excellent age hardenability has been regarded as difficult and thus has been a problem to be solved for many years.

Against this, Japanese Patent Laid-Open Publication Nos. 109927/1987 and 120217/1992 disclose that both bake hardenability and age hardenability are provided by utilizing molybdenum. According to finding by the present inventors, these methods specify only the content range of molybdenum as the additive element. In fact, however, the proposed methods are technically very unstable because the contemplated effect can be attained in some cases and cannot be attained in other cases depending upon the carbon content and the titanium and niobium contents. For example, in the prior art, regarding the addition of molybdenum, a mere description is found such that the amount of molybdenum added is in the range of 0.001 to 3.0% or in the range of 0.02 to 0.16%. That is, in the above methods, only sole use of molybdenum is accepted. Mere regulation of the amount of molybdenum added cannot provide a constant effect, and the level of the baking effect is 50 MPa in some cases and is as low as 10 MPa in other cases.

On the other hand, on the market, lightening of automobiles has led to an ever-increasing demand for an improvement in bake hardenability, and further improved bake hardenability and delay aging have become required in the art.

DISCLOSURE OF THE INVENTION

It is an object of the present invention to provide a cold rolled steel sheet which is simultaneously improved in both bake hardenability and delay aging, can ensure a stable bake hardening level, and, in addition, has larger bake hardenability than the prior art product.

According to one aspect of the present invention, there is provided a cold rolled steel sheet having improved bake hardenability, comprising by weight carbon: 0.0013 to 0.007%,
silicon: 0.001 to 0.08%,
manganese: 0.01 to 0.9%,
phosphorus: 0.001 to 0.10%,
sulfur: not more than 0.030%,
aluminum: 0.001 to 0.1%, and
nitrogen: not more than 0.01%, said steel sheet further comprising
titanium: 0.001 to 0.025% and
niobium: 0.001 to 0.040%, the titanium and niobium contents satisfying k value defined by the following formula:

$$k=\%C-12/93\times\%Nb-12/48\mathbf{33}\ (\%Ti-48/14\times\%N)\geqq 0.0008$$

wherein k=0 when $\%Ti-48/14\times\%N\leqq 0$, said steel sheet containing molybdenum as an additive on a level satisfying the following formulae:

$$0.005\leqq\%Mo\leqq 0.25$$

and $$0.1\times\sqrt{k}\leqq\%Mo\leqq 5\times\sqrt{k}$$

wherein k is as defined above.

According to a preferred embodiment of the present invention, boron is further added on a level satisfying the following formulae:

$$0.005\times\sqrt{k}\leqq\%B\leqq 0.08\times\sqrt{k},$$

and $$\%Mo/300\leqq\%B\leqq\%Mo/4.$$

Further, according to a preferred embodiment of the present invention, the dislocation density is 50 to 3,000 dislocation lines per $\mu m^2$ of plane field.

BEST MODE FOR CARRYING OUT THE INVENTION

Figure 1:
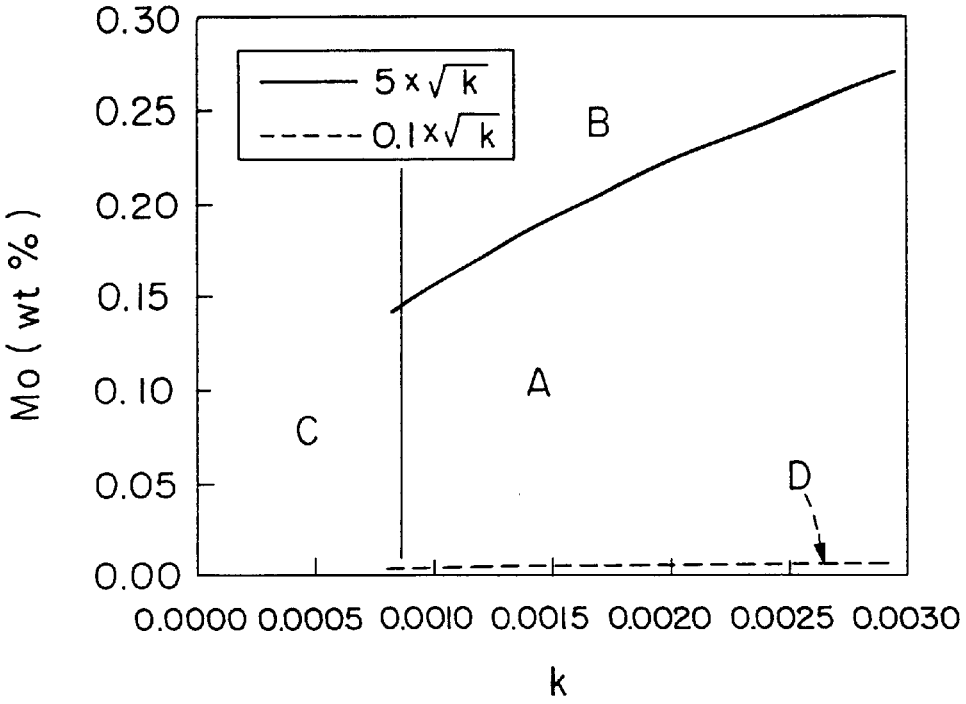
FIG. 1 is a diagram illustrating the relationship between molybdenum content and k value in the cold rolled steel sheet according to the present invention.

Cold rolled steel sheets contemplated in the present invention include cold rolled steel sheets and plated steel sheets which have been hot dip plated or electroplated with zinc or the like. The steel may be produced by any production process using a converter, an electric furnace, an open-hearth furnace or the like, and may be in the form of, for example, a slab prepared by casting in a mold followed by slabbing, or a slab prepared by continuous casting.

The present inventors have made various studies with a view to improving the bake hardenability of cold rolled steel sheets and, as a result, have obtained unexpected finding described below, which had led to the completion of the present invention.

As described above, for the conventional cold rolled steel sheets, the bake hardening level is low even though the cold rolled steel sheet has bake hardenability. For some conventional cold rolled steel sheets, the aging property is poor. Further, for some conventional cold rolled steel sheets, mere addition of one or two or more conventional carbide formers selected from molybdenum, chromium, vanadium, and tungsten cannot provide stable effect. Therefore, it has been difficult to provide both good bake hardenability and good aging property for more than 60 days.

The present inventors have found that the amount of molybdenum added has correlation with the amount of carbon added. They have further found that the amount of molybdenum added has correlation also with the content of boron. More specifically, the present inventors have made various tests and analyses and, as a result, have found that, only when the contents of molybdenum, carbon, and boron satisfy the following formulae, both the bake hardenability and age hardenability requirements can be simultaneously and satisfactorily met.

Specifically, it has been found that the effect is not developed unless molybdenum satisfies the following formulae:

$$0.005 \leqq \%Mo \leqq 0.25,$$

$$0.1 \times \sqrt{k} \leqq \%Mo \leqq 5 \times \sqrt{k},$$

and $$k = \%C - 12/93 \times \%Nb - 12/48 \times (\%Ti - 48/14 \times \%N),$$

and, in addition, the carbon level at that time is such as to satisfy $k \geqq 0.0008$.

Therefore, even though the molybdenum content is as low as about 0.01%, both the delay aging property and bake hardenability requirements are satisfied when the value of %C−12/9333 %Nb−12/48×(%Ti−48/14×%N) is small. Further, for example, even though the molybdenum content is high, the delay aging property is deteriorated when the value of %C−12/93×%Nb−12/48×(%Ti−48/14×%N) is large. Accordingly, it has been found that only the molybdenum content falling within the above content range satisfying the above relational expressions is effective.

Although the reason for this has not been fully elucidated yet and the present invention is not limited by any theory, it is believed that, under the above conditions, molybdenum and carbon form a dipole which prevents carbon from being fixed onto dislocation. Further, it is believed that, when molybdenum has a certain relationship with carbon, both excellent bake hardenability and excellent aging property are stably developed. Also for the carbon, it is important that the content of carbon be the content of carbon in solid solution represented by k=%C−12/93×%Nb−12/48×(%Ti−48/14×%N), rather than mere content of carbon in the steel.

It is believed that good delay property while enjoying good bake hardenability can be provided by decomposition of the dipole, at a temperature of about 170° C. at the time of baking, which causes carbon to be again dissolved in solid solution to fix the dislocation.

It has been found that, when chromium, vanadium, tungsten, or manganese is used, this effect cannot be attained at the bake hardening temperature and only molybdenum is useful for attaining the effect.

In FIG. 1, region A (including the boundary line) is the scope of the present invention. In this region, the bake hardenability and the delay aging property are excellent. In region B, although the bake hardenability and the delay aging property are excellent, the large molybdenum content results in increased strength which lowers the elongation and thus is likely to cause cracking upon pressing. In region C, the bake hardenability is unsatisfactory. In region D, the delay aging property is poor, and stretcher strain occurs at the time of pressing.

The present inventors have further found that the addition of molybdenum in combination with boron can further improve the bake hardenability.

Specifically, the effect of further improving the bake hardenability can be attained when the concentration of boron satisfies the following formulae $$0.005 \times \sqrt{k} \leqq \%B \leqq 0.08 \times \sqrt{k}$$

and $$k = \%C - 12/93 \times \%Nb - 12/48 \times (\%Ti - 48/14 \times \%N)$$

and, at the same time, when a requirement represented by the following formula is satisfied:

$$\%Mo/300 \leqq \%B \leqq \%Mo/4.$$

Whether this effect is attributable to the formation of a dipole by boron and molybdenum or the participation of boron in the dipole of molybdenum and carbon has not been fully elucidated yet. In any event, however, the addition of molybdenum in combination with boron can provide a further improvement in bake hardenability.

Figure 2:
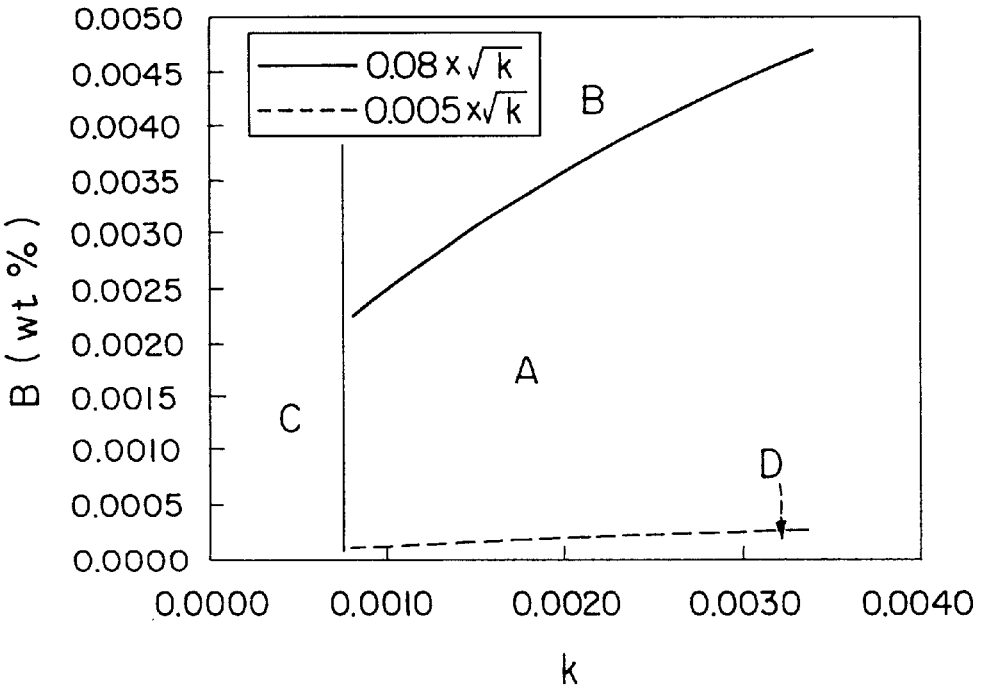
FIG. 2 is a diagram illustrating the relationship between boron content and k value in the cold rolled steel sheet according to the present invention.

In FIG. 2, region A (including the boundary line) is the scope of the present invention. In region A, the bake hardenability and the delay aging property are excellent. In region B, although the bake hardenability and the delay aging property are excellent, the large boron content results in lowered elongation which is likely to cause cracking at the time of pressing. In region C, the bake hardenability is unsatisfactory. In region D, the delay aging property is poor, and stretcher strain occurs at the time of pressing.

In this connection, it should be noted that the boron content range is further limited by the molybdenum content range.

In adding boron, it is important that nitrogen be in the state of fixation by titanium.

Further, the results of extensive observation under an electron microscope have revealed that the properties greatly vary depending upon the dislocation distribution. As a result of observation of samples having good delay aging properties under an electron microscope, the present inventors have found that, when the dislocation density is 50 to 3,000 dislocation lines per $\mu m^2$ of plane field, the delay aging property and the bake hardenability can be further improved. When the dislocation density is not less than 50 dislocation lines, the bake hardening property can be further improved, although the effect of the present invention does not disappear at a dislocation density of less than 50 dislocation lines. When the dislocation density is larger than 3,000 dislocation lines per $\mu m^2$, the elongation of the steel product is lowered and, in this case, cracking is likely to occur at the time of pressing. Although the reason for this has not been fully elucidated yet, it is considered that the dislocation forms a strain field which interacts with the dipole of molybdenum and boron or the dipole of molybdenum and carbon.

The reasons for the limitation of chemical compositions of the steel according to the present invention will be described.

Carbon: The carbon content is not less than 0.0013%. A carbon level of less than 0.0013% leads to a large increase in cost in steelmaking and, at the same time, makes it impossible to provide a high level of bake hardenability. The upper limit of the carbon content is 0.007%, because a carbon content exceeding 0.007% enhances the strength due to the function of the carbon as a steel strengthening element and thus is detrimental to workability. Further, in this case, the amount of titanium and niobium elements added is increased, and an increase in strength due to the occurrence of precipitates is unavoidable. This results in deteriorated workability and is also cost-ineffective. Furthermore, the delay aging property is also deteriorated.

Silicon: The silicon content is not less than 0.001%. A silicon level of less than 0.001% leads to an increase in cost in steelmaking and, at the same time, makes it impossible to provide a high level of bake hardenability. The upper limit of the silicon content is 0.08%. A silicon content exceeding 0.08% results in excessively high strength and thus is detrimental to workability. Further, in this case, at the time of galvanizing, zinc is less likely to be adhered to the steel sheet. That is, the silicon content exceeding 0.08% is detrimental to the adhesion of zinc to the steel sheet.

Manganese: The lower limit of the manganese content is 0.01%. When the manganese content is less than this lower limit, a high level of bake hardenability cannot be provided. The upper limit of the manganese content is 0.9%, because a manganese content exceeding 0.9% enhances the strength due to the function of the manganese as a steel strengthening element and thus is detrimental to workability.

Phosphorus: The phosphorus content is not less than 0.001%. A phosphorus level of less than 0.001% leads to a large increase in cost in steelmaking and, at the same time, makes it impossible to provide a high level of bake hardenability. The upper limit of the phosphorus content is 0.10%, because phosphorus, even when added in a small amount, functions as a steel strengthening element and enhances the strength and thus is detrimental to workability. Further, phosphorus is enriched in the grain boundaries, and is likely to cause grain boundary embrittlement, and the addition of phosphorus in an amount exceeding 0.10% is unfavorably detrimental to workability.

Sulfur: The sulfur content is not less than 0.030%. Sulfur is fundamentally an element the presence of which is meaningless in the steel. Further, sulfur forms TiS which unfavorably reduces effective titanium. Therefore, the lower the sulfur content, the better the results. On the other hand, a sulfur content exceeding 0.030% sometimes unfavorably causes, at the time of hot rolling, red shortness and in its turn surface cracking, that is, hot shortness.

Aluminum: The aluminum content is not less than 0.001%. Aluminum is a constituent necessary for deoxidation. When the aluminum content is less than 0.001%, gas holes are formed and become defects. For this reason, the aluminum content should be not less than 0.001%. The upper limit of the aluminum content is 0.1%, because the addition of aluminum in an amount exceeding 0.1% is cost-ineffective, and, further, in this case, the strength is enhanced resulting in deteriorated workability.

Nitrogen: The nitrogen content is not more than 0.01%. When the nitrogen is added in an amount of more than 0.01%, the amount of titanium added should be increased to ensure the necessary aging property, and, further, in this case, the strength is enhanced resulting in deteriorated workability.

Titanium and niobium are elements which are necessary for the so-called "Nb—Ti-IF steel" which are steels having good workability (or platability). The above defined respective titanium and niobium content ranges satisfy the property requirement. The lower limit of the titanium and niobium contents is 0.001%. When the content is less than 0.001%, it is difficult to ensure necessary aging property through the fixation of elements in solid solution, such as carbon and nitrogen. The upper limit of the titanium content is 0.025%, because the addition of titanium in an amount exceeding 0.025% saturates the delay aging property, increases the recrystallization temperature, and leads to deteriorated workability. The upper limit of the niobium content is 0.040%, because the addition of niobium in an amount exceeding 0.040% saturates the aging property, increases the recrystallization temperature, and leads to deteriorated workability.

Further, according to the present invention, it is important that the carbon content satisfy the following formula.

Specifically, it is important that the titanium and niobium contents be in the above respective ranges and, in addition, be set so as to satisfy the following formula: $k=\%C-12/93\times\%Nb-12/48\times(\%Ti-48/14\times\%N)\geqq 0.0008$. When the above requirement is not satisfied, the age hardenability cannot be ensured and the strength is hardly improved upon heat treatment at 170° C. for 20 min.

In the above formula, when $\%Ti-48/14\times\%N\leqq 0$, k is 0. In general, however, $\%Ti-48/14\times\%N$ is preferably greater than 0.

Molybdenum: The molybdenum content is not less than 0.005%. When the molybdenum content is less than 0.005%, the effect of enhancing the bake hardenability cannot be attained. The upper limit of the molybdenum content is 0.25%. A molybdenum content exceeding 0.25% excessively enhances the strength because molybdenum is a steel strengthening element and thus is detrimental to workability. Further, in this case, the bake hardenability is saturated, and, since molybdenum is expensive, this is disadvantageous from the viewpoint of economy.

Further, when the concentration of molybdenum is regulated to a level satisfying the following formula, the bake hardenability and the delay aging property are improved:

$$0.1\times\sqrt{k}\leqq\%Mo\leqq 5\times\sqrt{k}$$

wherein $k=\%C-12/93\times\%Nb-12/48\times(\%Ti-48/14\times\%N)$.

As described above, the molybdenum content range satisfying the above requirement is considered to be an optimal content range for forming a dipole of molybdenum and carbon. When the concentration of molybdenum relative to carbon is higher than required, the effect is saturated and, in addition, the cost becomes high. Further, in some cases, the elongation of steel products is lowered. For this reason, the upper limit of the molybdenum content is preferably 0.25%. A molybdenum content exceeding 0.25% is unfavorable because this excessively high content makes it difficult to cause recrystallization and is also likely to cause a lowering in elongation. In this case, however, the effect contemplated in the present invention per se does not disappear.

On the other hand, in the case of a molybdenum level of less than 0.005%, the age hardenability is not improved, and the YP elongation occurs.

The concentration of boron is particularly preferably in a range satisfying the following formula $$0.005\times\sqrt{k}\leqq\%B\leqq 0.08\times\sqrt{k}$$

wherein $k=\%C-12/93\times\%Nb-12/48\times(\%Ti-48/14\times\%N)$, and satisfying the following formula $$\%Mo/300\leqq\%B\leqq\%Mo/4.$$

When the boron content is less than $0.005\times\sqrt{k}$ and/or less than %Mo/300, the age hardenability is not improved and YP elongation occurs. When boron is added alone, the effect is small. The addition of boron in combination with molybdenum is particularly preferred. The addition of boron in an amount exceeding the above amount range results in saturated effect and thus is disadvantageous from the viewpoint of cost. Further, in this case, the total elongation is lowered, and the properties of steel products are unfavorably deteriorated.

EXAMPLES

Examples of the present invention, together with comparative examples, are shown in Tables 1 and 2.

Steels having chemical compositions indicated in Tables 1 and 2 were produced by the melt process in a converter, and then slabbed by continuous casting. The slabs were cold rolled and then annealed to prepare cold rolled steel sheets. In the measurement of the natural aging property, the steel sheets were held in an atmosphere of 40° C. for 70 days, and then subjected to a tensile test to measure YP elongation. When the YP elongation was not more than 0.02%, the natural aging property was regarded as good. In the measurement of the bake hardenability, the cold rolled steel sheets were pulled by 2%, and then held at 170° C. for 20 min. In this case, YP was measured. The difference between this strength and the strength measured by the above 2% tensile test was determined. For all the steel sheets according to the present invention, the delay aging level was not more than 0.01%, and the bake hardening level exceeded 50 MPa. By contrast, for comparative examples wherein the molybdenum content was low, the delay aging property was poor and exceeded 0.2%, and the bake hardening level was also low. For comparative examples wherein the molybdenum content was high, cracking occurred upon pressing although the delay aging and the bake hardening were good.

Tables 3 and 4 show the effect of the dislocation density. As is apparent from Tables 3 and 4, the examples of the present invention can exhibit an about 20 MPa improvement in bake hardening over the comparative examples. In Tables 3 and 4, the dislocation density was determined by extracting thin film test pieces from the cold rolled steel sheets, determining the dislocation of three thin film test pieces for each steel sheet by conventional observation under a transmission electron microscope, converting the dislocation to dislocation lines per $\mu m^2$, and determining the average value. For all the examples of the present invention, the natural aging level was as good as not more than 0.02%. Also for the bake hardenability, all the examples of the present invention were good and exhibited not less than 50 MPa.

Thus, the present invention can provide steel sheets having improved bake hardenability and delay aging property.

TABLE 1

| | Chemical composition, wt % | | | | | | | | | | | |
|---|---|---|---|---|---|---|---|---|---|---|---|---|
| | C | Si | Mn | P | S | Al | N | Nb | Ti | k | $0.1 \times \sqrt{k}$ | Mo |
| Ex. 1 | 0.0013 | 0.001 | 0.01 | 0.001 | 0.030 | 0.010 | 0.0025 | 0.001 | 0.009 | 0.0012 | 0.0034 | 0.005 |
| Ex. 2 | 0.0015 | 0.080 | 0.90 | 0.100 | 0.030 | 0.100 | 0.0025 | 0.003 | 0.009 | 0.0012 | 0.0034 | 0.020 |
| Ex. 3 | 0.0025 | 0.002 | 0.15 | 0.026 | 0.015 | 0.035 | 0.0027 | 0.006 | 0.009 | 0.0017 | 0.0041 | 0.020 |
| Ex. 4 | 0.0027 | 0.005 | 0.45 | 0.023 | 0.025 | 0.045 | 0.0029 | 0.007 | 0.010 | 0.0018 | 0.0042 | 0.025 |
| Ex. 5 | 0.0029 | 0.006 | 0.23 | 0.015 | 0.016 | 0.080 | 0.0031 | 0.007 | 0.011 | 0.0019 | 0.0044 | 0.030 |
| Ex. 6 | 0.0031 | 0.035 | 0.45 | 0.045 | 0.010 | 0.023 | 0.0033 | 0.008 | 0.011 | 0.0021 | 0.0045 | 0.050 |
| Ex. 7 | 0.0033 | 0.007 | 0.63 | 0.080 | 0.020 | 0.015 | 0.0035 | 0.009 | 0.012 | 0.0022 | 0.0047 | 0.220 |
| Ex. 8 | 0.0035 | 0.010 | 0.78 | 0.023 | 0.030 | 0.004 | 0.0025 | 0.009 | 0.009 | 0.0023 | 0.0048 | 0.230 |
| Ex. 9 | 0.0037 | 0.080 | 0.86 | 0.015 | 0.025 | 0.001 | 0.0025 | 0.010 | 0.009 | 0.0025 | 0.0050 | 0.150 |
| Ex. 10 | 0.0039 | 0.030 | 0.23 | 0.004 | 0.001 | 0.028 | 0.0027 | 0.010 | 0.009 | 0.0026 | 0.0051 | 0.180 |
| Ex. 11 | 0.0041 | 0.052 | 0.15 | 0.001 | 0.028 | 0.035 | 0.0029 | 0.011 | 0.010 | 0.0027 | 0.0052 | 0.050 |
| Ex. 12 | 0.0043 | 0.004 | 0.08 | 0.028 | 0.025 | 0.015 | 0.0031 | 0.011 | 0.011 | 0.0029 | 0.0054 | 0.012 |
| Ex. 13 | 0.0045 | 0.001 | 0.25 | 0.035 | 0.015 | 0.045 | 0.0033 | 0.012 | 0.011 | 0.0030 | 0.0055 | 0.010 |
| Ex. 14 | 0.0047 | 0.028 | 0.46 | 0.015 | 0.025 | 0.080 | 0.0035 | 0.012 | 0.012 | 0.0031 | 0.0056 | 0.023 |
| Ex. 15 | 0.0049 | 0.035 | 0.56 | 0.025 | 0.025 | 0.023 | 0.0037 | 0.013 | 0.013 | 0.0033 | 0.0057 | 0.056 |
| Ex. 16 | 0.0051 | 0.015 | 0.63 | 0.016 | 0.016 | 0.015 | 0.0039 | 0.013 | 0.013 | 0.0034 | 0.0058 | 0.120 |
| Ex. 17 | 0.0018 | 0.025 | 0.45 | 0.010 | 0.010 | 0.004 | 0.0041 | 0.002 | 0.014 | 0.0015 | 0.0039 | 0.150 |
| Ex. 18 | 0.0025 | 0.016 | 0.23 | 0.004 | 0.004 | 0.002 | 0.0031 | 0.006 | 0.011 | 0.0017 | 0.0041 | 0.180 |
| Ex. 19 | 0.0027 | 0.010 | 0.45 | 0.001 | 0.001 | 0.028 | 0.0033 | 0.007 | 0.011 | 0.0018 | 0.0042 | 0.025 |
| Ex. 20 | 0.0029 | 0.020 | 0.63 | 0.028 | 0.028 | 0.035 | 0.0035 | 0.007 | 0.012 | 0.0019 | 0.0044 | 0.035 |
| Ex. 21 | 0.0031 | 0.030 | 0.78 | 0.035 | 0.025 | 0.045 | 0.0037 | 0.008 | 0.013 | 0.0021 | 0.0045 | 0.040 |
| Ex. 22 | 0.0025 | 0.052 | 0.86 | 0.015 | 0.016 | 0.080 | 0.0031 | 0.006 | 0.011 | 0.0017 | 0.0041 | 0.025 |
| Ex. 23 | 0.0023 | 0.004 | 0.23 | 0.025 | 0.010 | 0.023 | 0.0033 | 0.006 | 0.011 | 0.0015 | 0.0039 | 0.030 |
| Ex. 24 | 0.0015 | 0.001 | 0.15 | 0.016 | 0.004 | 0.015 | 0.0035 | 0.001 | 0.012 | 0.0014 | 0.0037 | 0.050 |
| Ex. 25 | 0.0023 | 0.028 | 0.08 | 0.010 | 0.001 | 0.004 | 0.0037 | 0.006 | 0.013 | 0.0015 | 0.0039 | 0.150 |
| Ex. 26 | 0.0032 | 0.035 | 0.25 | 0.020 | 0.028 | 0.001 | 0.0039 | 0.008 | 0.013 | 0.0021 | 0.0046 | 0.210 |
| Ex. 27 | 0.0034 | 0.015 | 0.45 | 0.030 | 0.015 | 0.028 | 0.0041 | 0.009 | 0.014 | 0.0023 | 0.0048 | 0.150 |
| Ex. 28 | 0.0025 | 0.025 | 0.63 | 0.052 | 0.015 | 0.035 | 0.0043 | 0.006 | 0.015 | 0.0017 | 0.0041 | 0.180 |
| Ex. 29 | 0.0027 | 0.025 | 0.78 | 0.004 | 0.015 | 0.035 | 0.0045 | 0.007 | 0.015 | 0.0018 | 0.0042 | 0.050 |
| Ex. 30 | 0.0056 | 0.015 | 0.86 | 0.001 | 0.015 | 0.035 | 0.0047 | 0.014 | 0.016 | 0.0037 | 0.0061 | 0.025 |
| Ex. 31 | 0.0065 | 0.025 | 0.23 | 0.028 | 0.015 | 0.035 | 0.0049 | 0.017 | 0.017 | 0.0043 | 0.0066 | 0.030 |
| Ex. 32 | 0.0070 | 0.016 | 0.15 | 0.035 | 0.015 | 0.035 | 0.0051 | 0.018 | 0.017 | 0.0047 | 0.0068 | 0.050 |
| Ex. 33 | 0.0025 | 0.010 | 0.08 | 0.015 | 0.015 | 0.035 | 0.0053 | 0.006 | 0.018 | 0.0017 | 0.0041 | 0.250 |
| Ex. 34 | 0.0027 | 0.020 | 0.25 | 0.025 | 0.015 | 0.035 | 0.0055 | 0.007 | 0.019 | 0.0018 | 0.0042 | 0.050 |
| Ex. 35 | 0.0029 | 0.030 | 0.50 | 0.016 | 0.015 | 0.035 | 0.0057 | 0.007 | 0.020 | 0.0019 | 0.0044 | 0.012 |
| Ex. 36 | 0.0031 | 0.052 | 0.78 | 0.010 | 0.015 | 0.035 | 0.0059 | 0.008 | 0.020 | 0.0021 | 0.0045 | 0.010 |
| Ex. 37 | 0.0025 | 0.004 | 0.86 | 0.020 | 0.015 | 0.035 | 0.0061 | 0.006 | 0.021 | 0.0017 | 0.0041 | 0.023 |
| Ex. 38 | 0.0023 | 0.001 | 0.23 | 0.052 | 0.015 | 0.035 | 0.0063 | 0.006 | 0.022 | 0.0015 | 0.0039 | 0.056 |
| Ex. 39 | 0.0015 | 0.028 | 0.15 | 0.052 | 0.015 | 0.035 | 0.0065 | 0.004 | 0.022 | 0.0010 | 0.0032 | 0.120 |
| Comp. Ex. 1 | 0.0023 | 0.035 | 0.08 | 0.004 | 0.015 | 0.035 | 0.0067 | 0.006 | 0.023 | 0.0015 | 0.0039 | 0.001 |
| Comp. Ex. 2 | 0.0032 | 0.015 | 0.25 | 0.001 | 0.015 | 0.035 | 0.0069 | 0.008 | 0.024 | 0.0021 | 0.0046 | 0.002 |
| Comp. Ex. 3 | 0.0034 | 0.025 | 0.45 | 0.028 | 0.015 | 0.035 | 0.0071 | 0.009 | 0.024 | 0.0023 | 0.0048 | 0.003 |
| Comp. Ex. 4 | 0.0025 | 0.025 | 0.63 | 0.035 | 0.015 | 0.035 | 0.0073 | 0.006 | 0.025 | 0.0017 | 0.0041 | 0.500 |

TABLE 1-continued

| | Chemical composition, wt % | | | | | | | | | | | |
|---|---|---|---|---|---|---|---|---|---|---|---|---|
| | C | Si | Mn | P | S | Al | N | Nb | Ti | k | $0.1 \times \sqrt{k}$ | Mo |
| Comp. Ex. 5 | 0.0027 | 0.025 | 0.01 | 0.015 | 0.015 | 0.035 | 0.0075 | 0.007 | 0.026 | 0.0018 | 0.0042 | 0.600 |
| Comp. Ex. 6 | 0.0029 | 0.025 | 0.02 | 0.025 | 0.015 | 0.035 | 0.0077 | 0.007 | 0.026 | 0.0019 | 0.0044 | 0.001 |
| Comp. Ex. 7 | 0.0031 | 0.025 | 0.05 | 0.016 | 0.015 | 0.035 | 0.0079 | 0.008 | 0.027 | 0.0021 | 0.0045 | 0.500 |

TABLE 2

| | Chemical composition, wt % | | | | | | Tensile test | | |
|---|---|---|---|---|---|---|---|---|---|
| | | | | | | | Delay aging, | Bake hardening | |
| | $5 \times \sqrt{k}$ | $0.005 \times \sqrt{k}$ | B | $0.08 \times \sqrt{k}$ | Mo/300 | Mo/4 | % | MPa | Remarks |
| Ex. 1 | 0.17 | | — | | | | 0.01 | 56 | — |
| Ex. 2 | 0.17 | | — | | | | 0.00 | 60 | — |
| Ex. 3 | 0.20 | | — | | | | 0.00 | 58 | — |
| Ex. 4 | 0.21 | | — | | | | 0.00 | 62 | — |
| Ex. 5 | 0.22 | | — | | | | 0.00 | 66 | — |
| Ex. 6 | 0.23 | | — | | | | 0.00 | 70 | — |
| Ex. 7 | 0.23 | | — | | | | 0.00 | 74 | — |
| Ex. 8 | 0.24 | | — | | | | 0.00 | 78 | — |
| Ex. 9 | 0.25 | | — | | | | 0.00 | 82 | — |
| Ex. 10 | 0.25 | | — | | | | 0.00 | 86 | — |
| Ex. 11 | 0.26 | | — | | | | 0.00 | 90 | — |
| Ex. 12 | 0.27 | 0.0003 | 0.0005 | 0.0043 | 0.0000 | 0.0030 | 0.00 | 96 | — |
| Ex. 13 | 0.27 | 0.0003 | 0.0007 | 0.0044 | 0.0000 | 0.0025 | 0.00 | 100 | — |
| Ex. 14 | 0.28 | 0.0003 | 0.0008 | 0.0045 | 0.0001 | 0.0058 | 0.00 | 104 | — |
| Ex. 15 | 0.29 | 0.0003 | 0.0012 | 0.0046 | 0.0002 | 0.0140 | 0.00 | 108 | — |
| Ex. 16 | 0.29 | 0.0003 | 0.0013 | 0.0047 | 0.0004 | 0.0300 | 0.00 | 112 | — |
| Ex. 17 | 0.20 | 0.0002 | 0.0012 | 0.0031 | 0.0005 | 0.0375 | 0.00 | 56 | — |
| Ex. 18 | 0.20 | 0.0002 | 0.0014 | 0.0033 | 0.0006 | 0.0450 | 0.00 | 60 | — |
| Ex. 19 | 0.21 | 0.0002 | 0.0015 | 0.0034 | 0.0001 | 0.0063 | 0.00 | 64 | — |
| Ex. 20 | 0.22 | 0.0002 | 0.0010 | 0.0035 | 0.0001 | 0.0088 | 0.00 | 68 | — |
| Ex. 21 | 0.23 | 0.0002 | 0.0012 | 0.0036 | 0.0001 | 0.0100 | 0.00 | 72 | — |
| Ex. 22 | 0.20 | 0.0002 | 0.0014 | 0.0033 | 0.0001 | 0.0063 | 0.00 | 60 | — |
| Ex. 23 | 0.20 | 0.0002 | 0.0015 | 0.0031 | 0.0001 | 0.0075 | 0.00 | 56 | — |
| Ex. 24 | 0.19 | 0.0002 | 0.0005 | 0.0030 | 0.0002 | 0.0125 | 0.00 | 51 | — |
| Ex. 25 | 0.20 | 0.0002 | 0.0013 | 0.0031 | 0.0005 | 0.0375 | 0.00 | 56 | — |
| Ex. 26 | 0.23 | 0.0002 | 0.0016 | 0.0037 | 0.0007 | 0.0525 | 0.00 | 74 | — |
| Ex. 27 | 0.24 | 0.0002 | 0.0012 | 0.0038 | 0.0005 | 0.0375 | 0.00 | 78 | — |
| Ex. 28 | 0.20 | 0.0002 | 0.0013 | 0.0033 | 0.0006 | 0.0450 | 0.00 | 60 | — |
| Ex. 29 | 0.21 | 0.0002 | 0.0012 | 0.0034 | 0.0002 | 0.0125 | 0.00 | 64 | — |
| Ex. 30 | 0.31 | 0.0003 | 0.0020 | 0.0049 | 0.0001 | 0.0063 | 0.00 | 122 | — |
| Ex. 31 | 0.33 | 0.0003 | 0.0015 | 0.0053 | 0.0001 | 0.0075 | 0.00 | 140 | — |
| Ex. 32 | 0.34 | 0.0003 | 0.0010 | 0.0055 | 0.0002 | 0.0125 | 0.00 | 150 | — |
| Ex. 33 | 0.20 | 0.0002 | 0.0012 | 0.0033 | 0.0008 | 0.0625 | 0.00 | 60 | — |
| Ex. 34 | 0.21 | 0.0002 | 0.0015 | 0.0034 | 0.0002 | 0.0125 | 0.00 | 64 | — |
| Ex. 35 | 0.22 | 0.0002 | 0.0017 | 0.0035 | 0.0000 | 0.0030 | 0.00 | 68 | — |
| Ex. 36 | 0.23 | 0.0002 | 0.0019 | 0.0036 | 0.0000 | 0.0025 | 0.00 | 72 | — |
| Ex. 37 | 0.20 | 0.0002 | 0.0030 | 0.0033 | 0.0001 | 0.0058 | 0.00 | 60 | — |
| Ex. 38 | 0.20 | 0.0002 | 0.0023 | 0.0031 | 0.0002 | 0.0140 | 0.00 | 56 | — |
| Ex. 39 | 0.16 | 0.0002 | 0.0023 | 0.0025 | 0.0004 | 0.0300 | 0.10 | 58 | — |
| Comp. Ex. 1 | 0.20 | | — | | | | 0.12 | 25 | — |
| Comp. Ex. 2 | 0.23 | | — | | | | 0.06 | 43 | — |
| Comp. Ex. 3 | 0.24 | | — | | | | 0.20 | 45 | — |
| Comp. Ex. 4 | 0.20 | | — | | | | 0.00 | 60 | Cracked |
| Comp. Ex. 5 | 0.21 | | — | | | | 0.00 | 64 | Cracked |
| Comp. Ex. 6 | 0.22 | | — | | | | 0.06 | 39 | — |
| Comp. Ex. 7 | 0.23 | | — | | | | 0.00 | 41 | Cracked |

TABLE 3

| | Chemical composition, wt % | | | | | | | | | | | |
|---|---|---|---|---|---|---|---|---|---|---|---|---|
| | C | Si | Mn | P | S | Al | N | Nb | Ti | k | $0.1 \times \sqrt{k}$ | Mo |
| Ex. 1 | 0.0013 | 0.001 | 0.01 | 0.001 | 0.030 | 0.010 | 0.0025 | 0.001 | 0.009 | 0.0012 | 0.0034 | 0.005 |
| Ex. 2 | 0.0015 | 0.080 | 0.90 | 0.100 | 0.030 | 0.100 | 0.0025 | 0.003 | 0.009 | 0.0012 | 0.0034 | 0.020 |
| Ex. 3 | 0.0025 | 0.002 | 0.15 | 0.026 | 0.015 | 0.035 | 0.0027 | 0.006 | 0.009 | 0.0017 | 0.0041 | 0.020 |
| Ex. 4 | 0.0027 | 0.005 | 0.45 | 0.023 | 0.025 | 0.045 | 0.0029 | 0.007 | 0.010 | 0.0018 | 0.0042 | 0.025 |
| Ex. 5 | 0.0029 | 0.006 | 0.23 | 0.015 | 0.016 | 0.080 | 0.0031 | 0.007 | 0.011 | 0.0019 | 0.0044 | 0.030 |
| Ex. 6 | 0.0031 | 0.035 | 0.45 | 0.045 | 0.010 | 0.023 | 0.0033 | 0.008 | 0.011 | 0.0021 | 0.0045 | 0.050 |
| Ex. 7 | 0.0033 | 0.004 | 0.08 | 0.028 | 0.025 | 0.015 | 0.0031 | 0.009 | 0.011 | 0.0022 | 0.0047 | 0.012 |
| Ex. 8 | 0.0025 | 0.001 | 0.25 | 0.035 | 0.015 | 0.045 | 0.0033 | 0.006 | 0.011 | 0.0017 | 0.0041 | 0.010 |
| Ex. 9 | 0.0023 | 0.028 | 0.46 | 0.015 | 0.025 | 0.080 | 0.0035 | 0.006 | 0.012 | 0.0015 | 0.0039 | 0.023 |
| Ex. 10 | 0.0015 | 0.035 | 0.56 | 0.025 | 0.025 | 0.023 | 0.0037 | 0.004 | 0.013 | 0.0010 | 0.0032 | 0.056 |
| Ex. 11 | 0.0023 | 0.015 | 0.63 | 0.016 | 0.016 | 0.015 | 0.0039 | 0.006 | 0.013 | 0.0015 | 0.0039 | 0.120 |
| Ex. 12 | 0.0032 | 0.025 | 0.45 | 0.010 | 0.010 | 0.004 | 0.0041 | 0.002 | 0.014 | 0.0029 | 0.0054 | 0.150 |
| Ex. 13 | 0.0034 | 0.016 | 0.23 | 0.004 | 0.004 | 0.002 | 0.0031 | 0.009 | 0.011 | 0.0023 | 0.0048 | 0.230 |
| Ex. 14 | 0.0036 | 0.010 | 0.45 | 0.001 | 0.001 | 0.028 | 0.0033 | 0.009 | 0.011 | 0.0024 | 0.0049 | 0.025 |
| Comp. Ex. 1 | 0.0013 | 0.001 | 0.01 | 0.001 | 0.030 | 0.010 | 0.0025 | 0.001 | 0.009 | 0.0012 | 0.0034 | 0.005 |
| Comp. Ex. 2 | 0.0015 | 0.080 | 0.90 | 0.100 | 0.030 | 0.100 | 0.0025 | 0.003 | 0.009 | 0.0012 | 0.0034 | 0.020 |
| Comp. Ex. 3 | 0.0025 | 0.002 | 0.15 | 0.026 | 0.015 | 0.035 | 0.0027 | 0.006 | 0.009 | 0.0017 | 0.0041 | 0.020 |
| Comp. Ex. 4 | 0.0027 | 0.005 | 0.45 | 0.023 | 0.025 | 0.045 | 0.0029 | 0.007 | 0.010 | 0.0018 | 0.0042 | 0.025 |
| Comp. Ex. 5 | 0.0029 | 0.006 | 0.23 | 0.015 | 0.016 | 0.080 | 0.0031 | 0.007 | 0.011 | 0.0019 | 0.0044 | 0.030 |
| Comp. Ex. 6 | 0.0031 | 0.035 | 0.45 | 0.045 | 0.010 | 0.023 | 0.0033 | 0.008 | 0.011 | 0.0021 | 0.0045 | 0.050 |
| Comp. Ex. 7 | 0.0033 | 0.004 | 0.08 | 0.028 | 0.025 | 0.015 | 0.0031 | 0.009 | 0.011 | 0.0022 | 0.0047 | 0.012 |
| Comp. Ex. 8 | 0.0025 | 0.001 | 0.25 | 0.035 | 0.015 | 0.045 | 0.0033 | 0.006 | 0.011 | 0.0017 | 0.0041 | 0.010 |
| Comp. Ex. 9 | 0.0023 | 0.028 | 0.46 | 0.015 | 0.025 | 0.080 | 0.0035 | 0.006 | 0.012 | 0.0015 | 0.0039 | 0.023 |
| Comp. Ex. 10 | 0.0015 | 0.035 | 0.56 | 0.025 | 0.025 | 0.023 | 0.0037 | 0.004 | 0.013 | 0.0010 | 0.0032 | 0.056 |
| Comp. Ex. 11 | 0.0023 | 0.015 | 0.63 | 0.016 | 0.016 | 0.015 | 0.0039 | 0.006 | 0.013 | 0.0015 | 0.0039 | 0.120 |
| Comp. Ex. 12 | 0.0032 | 0.025 | 0.45 | 0.010 | 0.010 | 0.004 | 0.0041 | 0.002 | 0.014 | 0.0029 | 0.0054 | 0.150 |
| Comp. Ex. 13 | 0.0034 | 0.016 | 0.23 | 0.004 | 0.004 | 0.002 | 0.0031 | 0.009 | 0.011 | 0.0023 | 0.0048 | 0.230 |
| Comp. Ex. 14 | 0.0036 | 0.010 | 0.45 | 0.001 | 0.001 | 0.028 | 0.0033 | 0.009 | 0.011 | 0.0024 | 0.0049 | 0.025 |
| Comp. Ex. 15 | 0.0023 | 0.035 | 0.08 | 0.004 | 0.015 | 0.035 | 0.0067 | 0.006 | 0.023 | 0.0015 | 0.0039 | 0.001 |
| Comp. Ex. 16 | 0.0030 | 0.025 | 0.05 | 0.016 | 0.015 | 0.035 | 0.0079 | 0.008 | 0.027 | 0.0020 | 0.0045 | 0.500 |

TABLE 4

| | Chemical composition, wt % | | | | | | Dislocation density, | Tensile test | | |
|---|---|---|---|---|---|---|---|---|---|---|
| | | | | | | | | Delay aging | Bake hardening | |
| | $5 \times \sqrt{k}$ | $0.005 \times \sqrt{k}$ | B | $0.08 \times \sqrt{k}$ | Mo/300 | Mo/4 | lines/$\mu m^2$ | % | MPa | Remarks |
| Ex. 1 | 0.171 | | | | | | 50 | 0.01 | 56 | — |
| Ex. 2 | 0.172 | | | | | | 100 | 0.00 | 63 | — |
| Ex. 3 | 0.204 | | | | | | 250 | 0.00 | 60 | — |
| Ex. 4 | 0.212 | | | | | | 3000 | 0.00 | 64 | — |
| Ex. 5 | 0.220 | | | | | | 1500 | 0.00 | 68 | — |
| Ex. 6 | 0.227 | | | | | | 300 | 0.00 | 72 | — |
| Ex. 7 | 0.235 | 0.0002 | 0.0005 | 0.0038 | 0.0000 | 0.0030 | 3000 | 0.00 | 78 | — |
| Ex. 8 | 0.204 | 0.0002 | 0.0007 | 0.0033 | 0.0000 | 0.0025 | 50 | 0.00 | 62 | — |
| Ex. 9 | 0.196 | 0.0002 | 0.0008 | 0.0031 | 0.0001 | 0.0058 | 100 | 0.00 | 58 | — |
| Ex. 10 | 0.158 | 0.0002 | 0.0012 | 0.0025 | 0.0002 | 0.0140 | 250 | 0.00 | 42 | — |
| Ex. 11 | 0.196 | 0.0002 | 0.0013 | 0.0031 | 0.0004 | 0.0300 | 300 | 0.00 | 58 | — |
| Ex. 12 | 0.271 | 0.0003 | 0.0012 | 0.0043 | 0.0005 | 0.0375 | 1500 | 0.00 | 100 | — |
| Ex. 13 | 0.238 | 0.0002 | 0.0014 | 0.0038 | 0.0008 | 0.0575 | 2500 | 0.00 | 80 | — |
| Ex. 14 | 0.245 | 0.0002 | 0.0015 | 0.0039 | 0.0001 | 0.0063 | 3000 | 0.00 | 84 | — |
| Comp. Ex. 1 | 0.171 | | — | | | | 10 | 0.01 | 43 | — |
| Comp. Ex. 2 | 0.172 | | — | | | | 25 | 0.00 | 43 | — |
| Comp. Ex. 3 | 0.204 | | — | | | | 10 | 0.00 | 58 | — |
| Comp. Ex. 4 | 0.212 | | — | | | | 25 | 0.00 | 62 | — |
| Comp. Ex. 5 | 0.220 | | — | | | | 15 | 0.00 | 66 | — |
| Comp. Ex. 6 | 0.227 | | — | | | | 26 | 0.00 | 70 | — |
| Comp. Ex. 7 | 0.235 | 0.0002 | 0.0005 | 0.0038 | 0.0000 | 0.0030 | 34 | 0.00 | 76 | — |
| Comp. Ex. 8 | 0.204 | 0.0002 | 0.0007 | 0.0033 | 0.0000 | 0.0025 | 45 | 0.00 | 60 | — |
| Comp. Ex. 9 | 0.196 | 0.0002 | 0.0008 | 0.0031 | 0.0001 | 0.0058 | 12 | 0.00 | 56 | — |

What is claimed is:

1. A cold rolled steel sheet having improved bake hardenability, comprising by weight carbon: 0.0013 to 0.007%, silicon: 0.001 to 0.08%, manganese: 0.01 to 0.9%, phosphorus: 0.001 to 0.10%, sulfur: not more than 0.030%, aluminum: 0.001 to 0.1%, and nitrogen: not more than 0.01%, said steel sheet further comprising titanium: 0.001 to 0.025% and niobium: 0.001 to 0.040%, the titanium and niobium contents satisfying k value defined by the following formula:

$$k=\%C-12/93\times\%Nb-12/48\times(\%Ti-48/14\times\%N)\geqq 0.0008$$

wherein k=0 when $\%Ti-48/14\times\%N\leqq 0$, said steel sheet containing molybdenum as an additive on a level satisfying the following formulae:

$$0.005\leqq\%Mo\leqq 0.25$$

and $$0.1\times\sqrt{k}\leqq\%Mo\leqq 5\times\sqrt{k}$$

wherein k is as defined above.

2. The cold rolled steel sheet according to claim 1, which further contains boron on a level satisfying the following formulae:

$$0.005\times\sqrt{k}\leqq\%B\leqq 0.08\times\sqrt{k}$$

wherein k is as defined above, and $$\%Mo/300\leqq\%B\leqq\%Mo/4.$$

3. The cold rolled steel sheet according to claim 1, which has a dislocation density of 50 to 3,000 dislocation lines per $\mu m^2$ of plane field.

* * * * *